US008523047B2

(12) United States Patent
Holley, Jr.

(10) Patent No.: US 8,523,047 B2
(45) Date of Patent: Sep. 3, 2013

(54) HANDLE STRUCTURE

(75) Inventor: John M. Holley, Jr., Lawrenceville, GA (US)

(73) Assignee: MeadWestvaco Packaging Systems, LLC, Richmond, VA (US)

( * ) Notice: Subject to any disclaimer, the term of this patent is extended or adjusted under 35 U.S.C. 154(b) by 343 days.

(21) Appl. No.: 12/903,080

(22) Filed: Oct. 12, 2010

(65) Prior Publication Data

US 2011/0248078 A1 Oct. 13, 2011

Related U.S. Application Data

(60) Provisional application No. 61/250,668, filed on Oct. 12, 2009.

(51) Int. Cl.
*B65D 5/468* (2006.01)

(52) U.S. Cl.
USPC ..... 229/117.16; 229/117.13; 229/117.14

(58) Field of Classification Search
USPC ..... 229/117.13, 117.14, 117.16, 117.17; 206/141, 427
See application file for complete search history.

(56) References Cited

U.S. PATENT DOCUMENTS

| | | | | |
|---|---|---|---|---|
| 2,548,130 | A * | 4/1951 | Stephan | 229/117.16 |
| 3,797,731 | A * | 3/1974 | Weldon | 229/117.16 |
| 4,405,078 | A * | 9/1983 | Dutcher et al. | 229/117.13 |
| 5,267,644 | A * | 12/1993 | Tsao | 229/117.14 |
| 6,631,803 | B2 * | 10/2003 | Rhodes et al. | 206/427 |
| 7,578,385 | B2 | 8/2009 | Holley | |
| 7,775,418 | B2 | 8/2010 | Walling | |
| 2006/0081691 | A1 * | 4/2006 | Smalley | 229/117.16 |
| 2006/0278689 | A1 * | 12/2006 | Boshinski et al. | 229/117.16 |
| 2008/0110967 | A1 * | 5/2008 | Walling | 229/117.16 |
| 2009/0212095 | A1 * | 8/2009 | Auclair | 229/117.17 |

FOREIGN PATENT DOCUMENTS

| | | | |
|---|---|---|---|
| WO | 2008/061168 | A2 | 5/2008 |
| WO | 2010/009293 | A1 | 1/2010 |

* cited by examiner

*Primary Examiner* — Gary Elkins
(74) *Attorney, Agent, or Firm* — MWV Intellectual Property Group

(57) ABSTRACT

A handle structure includes a reinforcing flap struck from a handle panel to define at least a part of a handle opening for insertion of a user's hand. The reinforcing flap comprises a first portion and a second portion connected to one another by a narrow portion defined by an indent in a free edge of the reinforcing flap.

16 Claims, 7 Drawing Sheets

HANDLE STRUCTURE

CROSS REFERENCE TO RELATED APPLICATION

This application claims priority to U.S. Provisional Application No. 61/250,668, filed Oct. 12, 2009, the entirety of which is incorporated herein by reference.

FIELD OF THE INVENTION

The present invention relates generally though not specifically to handle structures for use in cartons for packaging articles. More specifically, though still not exclusively, the invention relates to handle structures comprising foldable flaps that hinge upon insertion of a user's fingers into the handle structure so as to resist tearing.

BACKGROUND OF THE INVENTION

It is known in the art to provide handle openings in packaging such as cartons so as to allow users to insert one or more fingers to allow lifting of those packages. When packages are so lifted the weight of those packages is transferred to one or more edges of the handle openings and this load may in some cases lead to tearing. This problem is exacerbated if the material of the packaging is to some degree moistened as moisture weakens the materials such as paperboard of which packaging is often manufactured.

Tearing may manifest not only in a "vertical" direction, which is to say parallel to the direction of the force created by the load of the packaging, but also in a "horizontal" perpendicular to the aforesaid vertical direction as the package is manipulated and twisted.

There therefore exists a need for a handle opening which lessens or altogether eliminates the risk of tearing in both the aforesaid "vertical" and "horizontal" directions of the handle opening.

The present invention seeks fulfill to some degree the aforementioned need by providing a handle opening that resists tearing.

SUMMARY OF INVENTION

A first aspect of the present invention provides a handle structure for a carton for packaging articles, which handle structure comprises a handle panel, and a reinforcing flap struck from a handle opening defined in the handle opening, the reinforcing flap comprising a first portion and a second portion connected to one another by a narrow portion defined by an indent in a free edge of the reinforcing flap, and being hinged to the handle panel along a fold line so as to allow only partial folding of the first portion out of the plane of the handle opening, whereby to at least partially direct stresses placed upon the first portion, around the indent, and into portions of the handle panel to which the second portion is hinged.

Preferably, a base of said indent is positioned proximate, but offset from, the fold line hinging the reinforcing flap to a handle panel.

Preferably, the fold line is curved proximate the base of the indent.

Preferably, the base of the indent is rounded.

Preferably, the reinforcing flap narrows at its terminal ends.

Optionally, one portion of the reinforcing flap extends adjacent to an edge of the aperture between a fold line connecting the reinforcing flap to a handle panel in which reinforcing flap is defined, and a connection between the reinforcing flap an that handle panel, proximate a terminal end of that handle panel.

Optionally, the handle panel further comprises a cover panel, defined within which is a comfort flap that is hinged thereto. The comfort flap is sized such that is foldable through the handle opening and positioned such that it is in registry with the handle opening, and comprises detents that, when the comfort flap is so-folded, are engageable with the indent of said reinforcing flap to maintain the comfort flap in a fixed position.

Preferably, the handle panel is a first end panel of a carton.

Preferably, the aperture is formed of a cutout in a free edge of the first end panel, and a second cutout in a free edge of a second end panel of a carton, which first and second end panels are adjacent in coplanar relationship to close an end of the carton.

Preferably, a portion of one of the first and second end panels extends to the other of the first and second end panels, so as to form a edge of the carton handle opening, by which the carton can be lifted.

A second aspect of the present invention provides a blank for forming a carton having a handle structure, which blank comprises panels for forming opposed side walls and opposed top and bottom wall, to form a tubular structure, and panels to form end closure panels of that tubular structure, which end closure panels comprise a first and a second side end panels, each comprising a free edge furthest from a fold line hinging that end panel to the panels for forming the carton, within which free edge is defined a cutout, defined within which cutout is a reinforcing flap comprising a first portion and a second portion connected to one another by a narrow portion defined by an indent in a free edge of the reinforcing flap, and being hinged to the side end panel so as to allow only partial folding of the first portion out of the plane of the handle opening, whereby to at least partially direct stresses placed upon the first portion, around the indent, and into portions of the side end panel to which the second portion is hinged.

Preferably, the blank further comprises a top end panel that is foldable to overly the first and second end panels, defined within which top end panel is a comfort flap that is foldable through the handle opening and that comprises a tab that is engageable with said indent to maintain the comfort flap in a folded condition.

BRIEF DESCRIPTION OF THE DRAWINGS

Exemplary embodiments of the invention will now be described with reference to the accompanying drawings, in which.

DETAILED DESCRIPTION OF PREFERRED EMBODIMENTS

Figure 2:
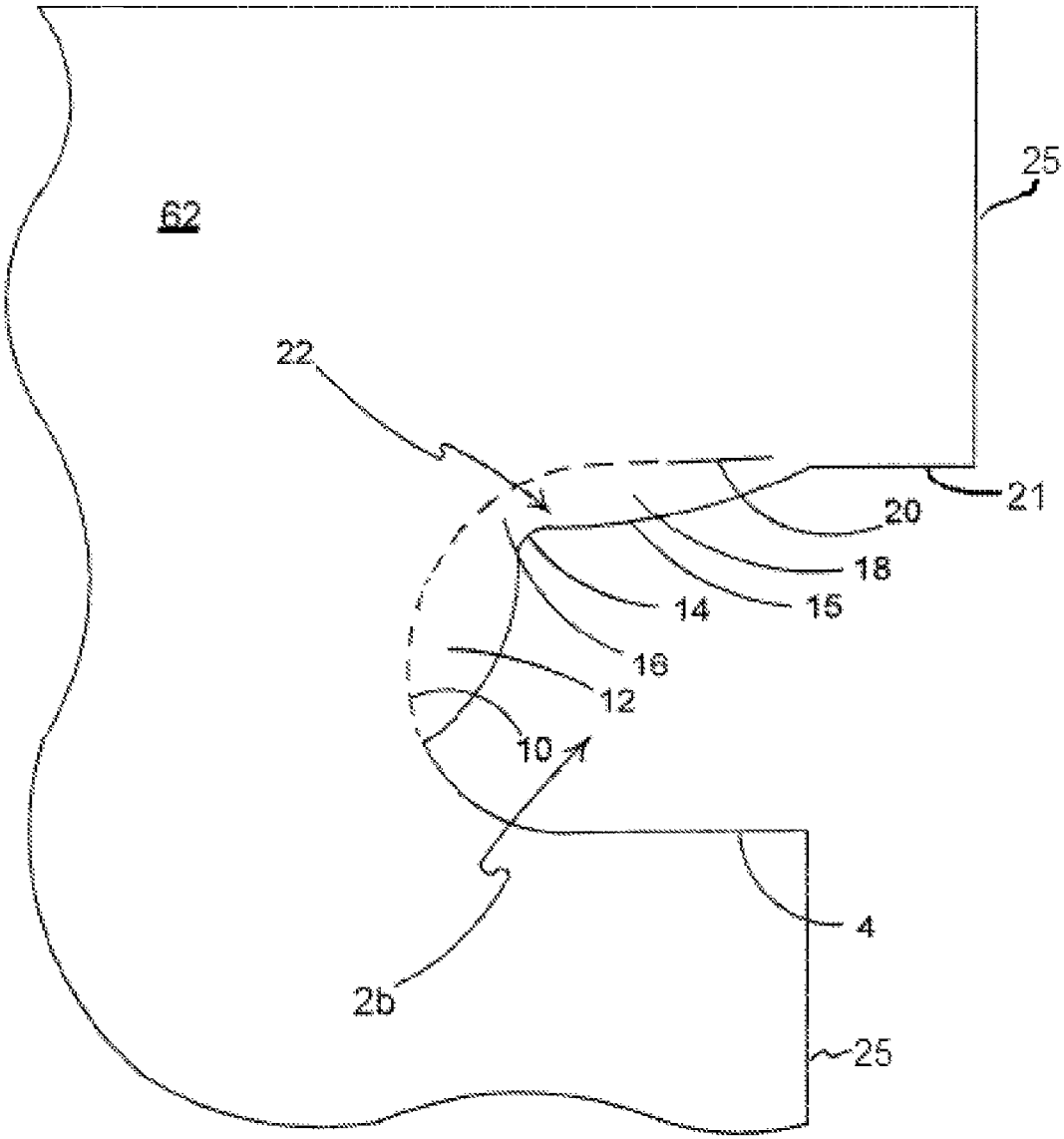
FIG. 2 shows an enlarged view of a handle cutout formed in one of the end panels of the blank of FIG. 1.

The present invention relates, in a preferred embodiment, to a handle structure 1 comprising a handle opening 3 formed from a first handle cutout 2*a*, and a second handle cutout 2*b* (shown best in FIG. 2) defined in adjacent terminal edges of two adjacent handle panels 58, 62, and defined within each of which are reinforcing flaps 22.

The handle cutouts 2*a*, 2*b* in each of the handle panels 58, 62 are substantially the mirror image of the other, but differ from one another in the manner set out below.

The first handle cutout 2*a* in handle panel 58 is defined partially by upper and lower cut lines 20, 4. The upper cut lines 20 extends from a point inwardly offset from the terminal edge 25 of the handle panel 58, whilst the lower cut line 4 extend inwardly from the terminal edge 25 itself. A score line 10 connects adjacent terminal ends of those cut lines 4, 20.

The upper cut line 20 is linear and co-axial with a linear first portion of the score line 10, which score line 10 and upper cut line 20 together form an upper boundary of the handle opening 3 when the reinforcing flap 22 is folded or otherwise somewhat deformed into a position of use in the manner described below. The score line 10 terminates in a curved portion that defines an upper corner of the first handle cutout 2*a*, and the lower cut line 4 extends from a terminal point on the score line 10 to continue the curve thereof, thereby to define a lower corner of the first handle cutout 2*a*, before extending linearly therefrom to the terminal edge of the handle panel 58. Thus, linear upper and lower boundaries of the cutout 2*a* are defined, joined by a rounded end.

Figure 3:
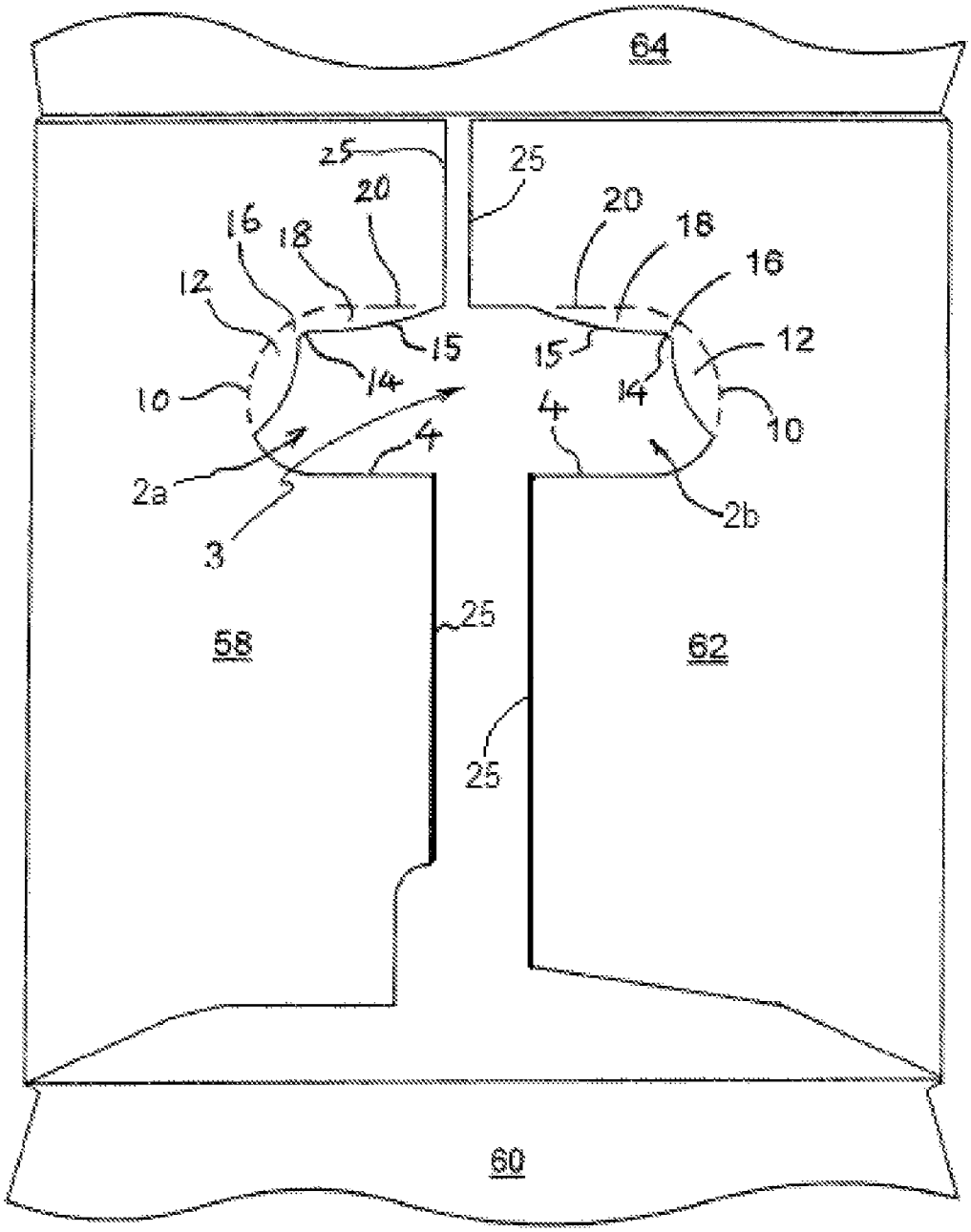
FIG. 3 shows an end view of a partially erected blank of FIG. 1, wherein the handle cutouts of two adjacent end panels have been formed together into a carton handle opening.

The reinforcing flap 22 is connected to the handle panel 58 by the score line 10, and further is connected to handle panel 58 adjacent the terminal edge thereof, where the upper cut line 20 terminates at a point offset from that edge (as best shown in FIG. 3).

The reinforcing flap 22 comprises an upper portion 18, and a lower portion 12, connected to one another by a narrow portion 16. The reduced width of the reinforcing flap 22 at this narrow portion 16 is due to an indent 14 formed in a free edge 15 of the reinforcing flap 22 opposing the score line 10.

The indent 14 in the reinforcing flap 22 is rounded at its base, which is to say, at a point closest to the score line 10. The base of the indent 14 is spaced from the score line 10, and is substantially proximate the curved portion thereof described above. The upper portion 18 of the reinforcing flap 22 extends along the linear portion of the score line 10 and continues, adjacent the upper cut line 20, to the terminal edge of the handle panel 58, where it is connected to the handle panel 58 across the offset between the first cut line 20 and the terminal edge. The lower portion 12 of the reinforcing flap 22 extends from the indent 14 to a lower terminal end of the score line 10.

The second handle cutout 2*b* is formed in a second end panel 62 (shown in an enlarged view in FIG. 2) and is substantially the mirror image of the first handle cutout 2*a*, with the addition that an edge 21 of the handle panel 62 extends along the same axis as the upper cut line 20, to define an portion of the handle panel 62 extending beyond a terminal end of the reinforcing flap 22 where it is connected to the handle panel 62. Thus, whereas the portion by which the reinforcing flap 22 of the first cutout 2*a* is connected to the handle panels 58 adjacent a terminal edge thereof, this is not the case in this second handle panel 62, where there is an extended portion of the handle panel extending away from a terminal point of the reinforcing flap 22, in the axis of the upper cut line 20.

Figure 1:
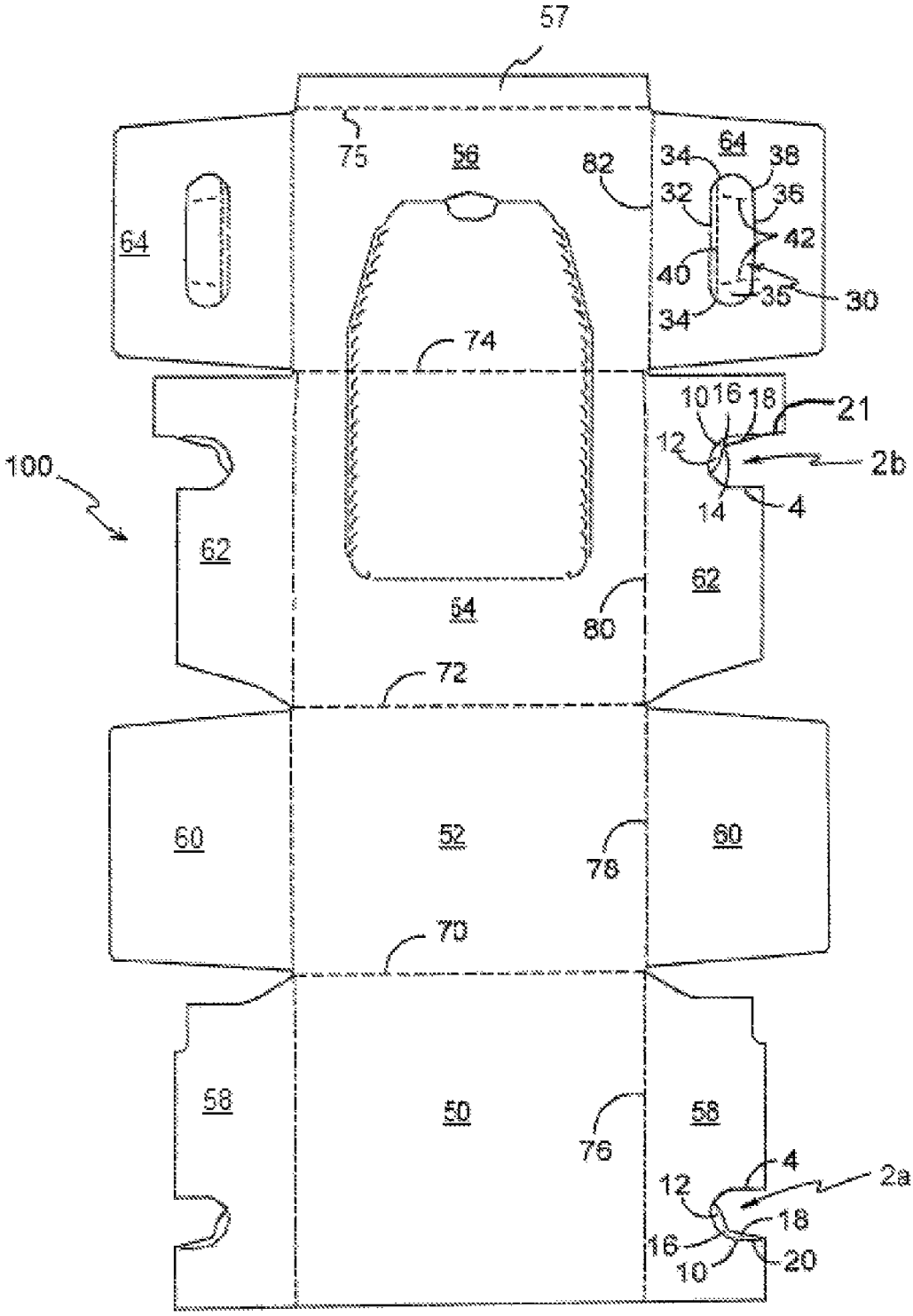
FIG. 1 shows a blank for forming a carton, comprising a handle structure according to a first embodiment of the present invention.
Figure 4:
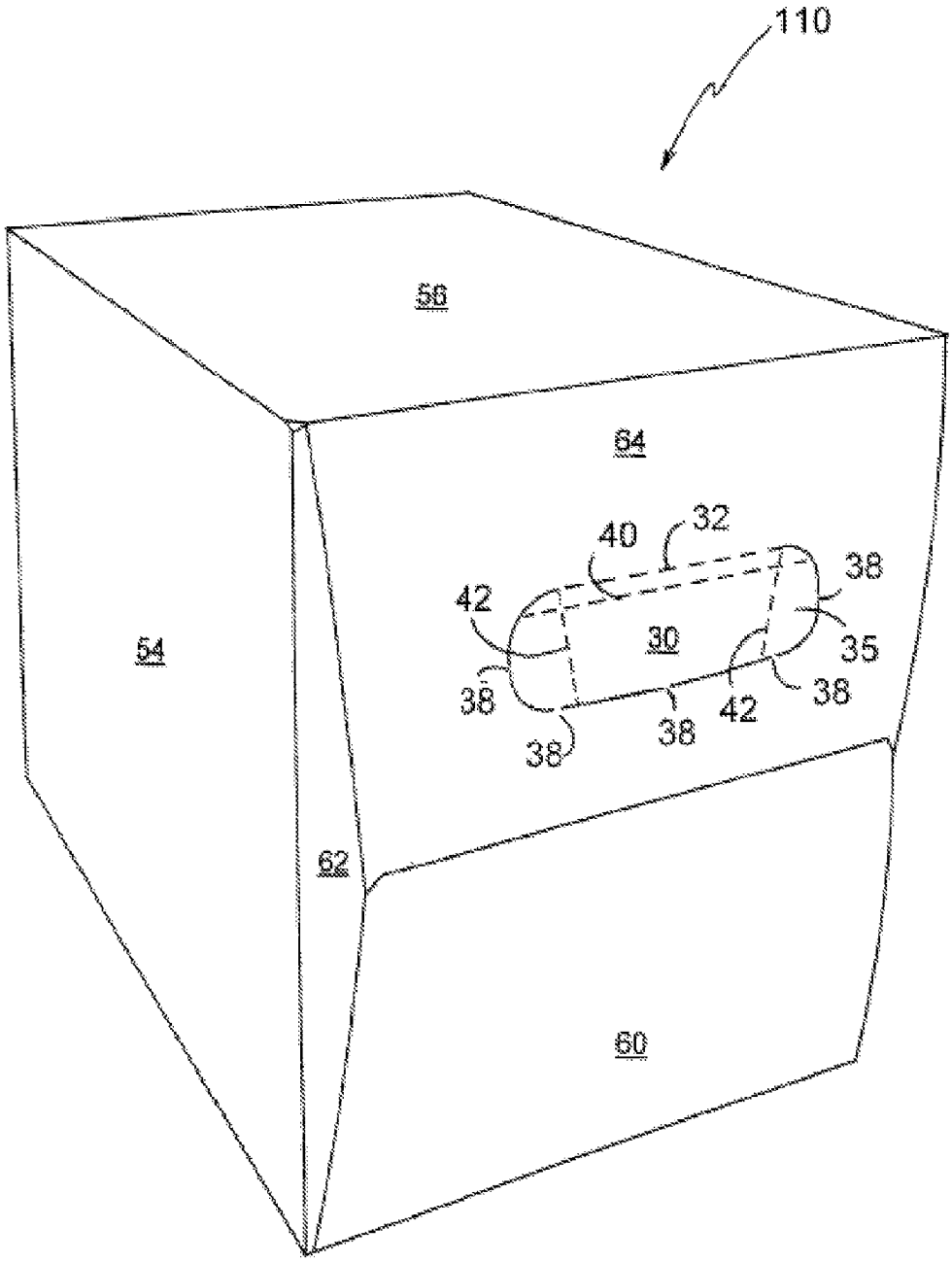
FIG. 4 shows a fully erected carton from the blank of FIG. 1.

Referring to FIGS. 1 and 4, the handle structure 1 also preferably comprises a comfort flap 30 that is foldable into the handle opening 3, to act as a reinforcing layer, and to increase the surface area the handle structure 1, with which the users hands come into contact when the handle structure 1 is being used, as is described below. Preferably, the comfort flap 30 hingedly connected to a cover panel such as a top end panel 64 and is positioned in registry with the handle opening 3 (best shown in FIG. 3) formed by the two juxtaposed handle cutouts 2*a*, 2*b*. Specifically, it is advantageous that a fold line 32 about which the comfort flap 30 hinged to the top end panel 64 is in registry with the axis of the upper cut lines 20, and linear portions of the score lines 10 of the two handle cutouts 2*a*, 2*b*.

The comfort flap 30 is of the same size and shape as, or slightly smaller than, the handle opening 3, to aid insertion of the one into the other. The first fold line 32 by which the comfort flap 30 may be hinged to the top end panel 64 of a carton, for example, is mirrored by an offset fold line 40, spaced from the first fold line 32 by a small distance preferably equal to the maximum width of the upper portion 18 of the reinforcing flap 22. Separating a central portion of the comfort flap 30 from end tabs 35 thereof are fold lines 42, one at each end.

Figure 5:
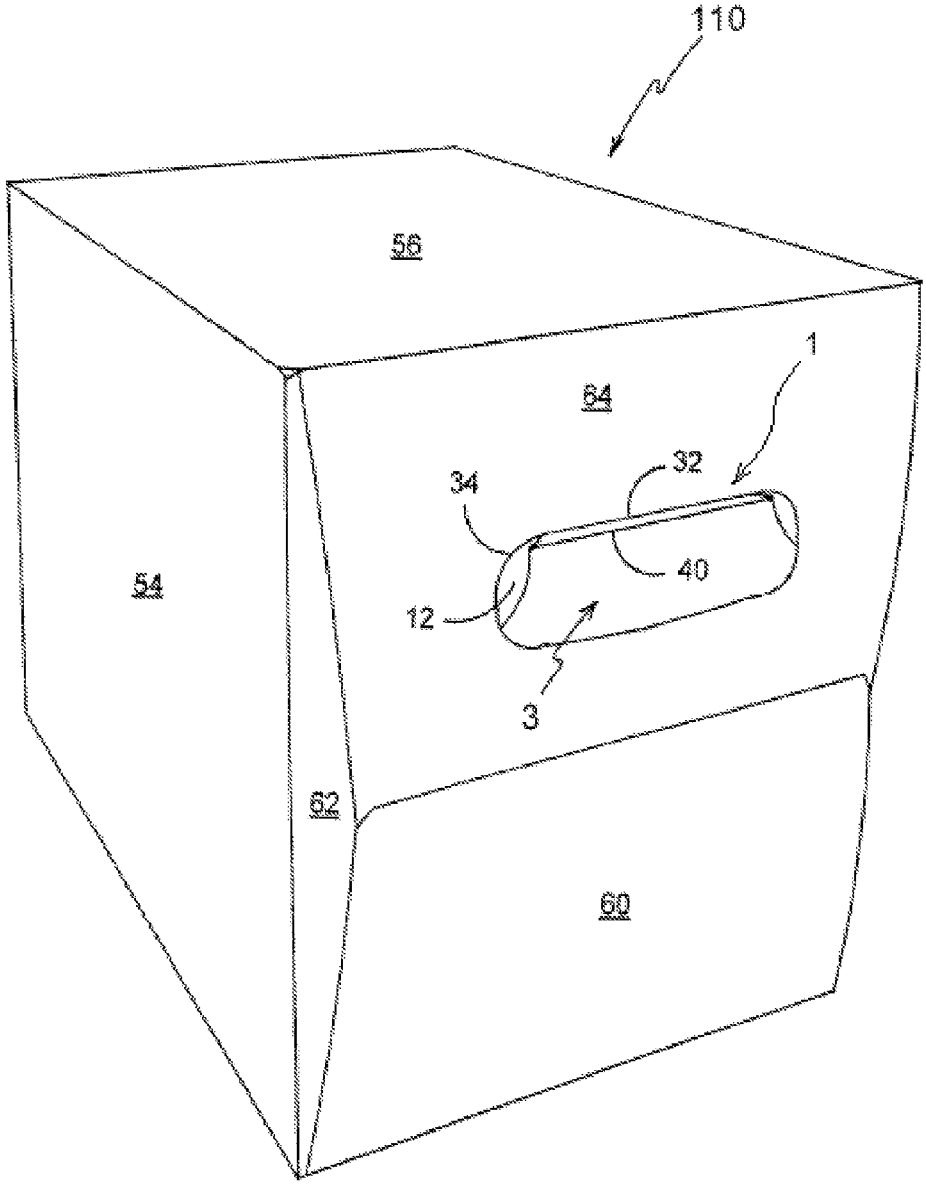
FIG. 5 shows the carton of FIG. 4, wherein the comfort flap has been inserted into the handle cutouts of the end panels view from the exterior of the carton.
Figure 6A:
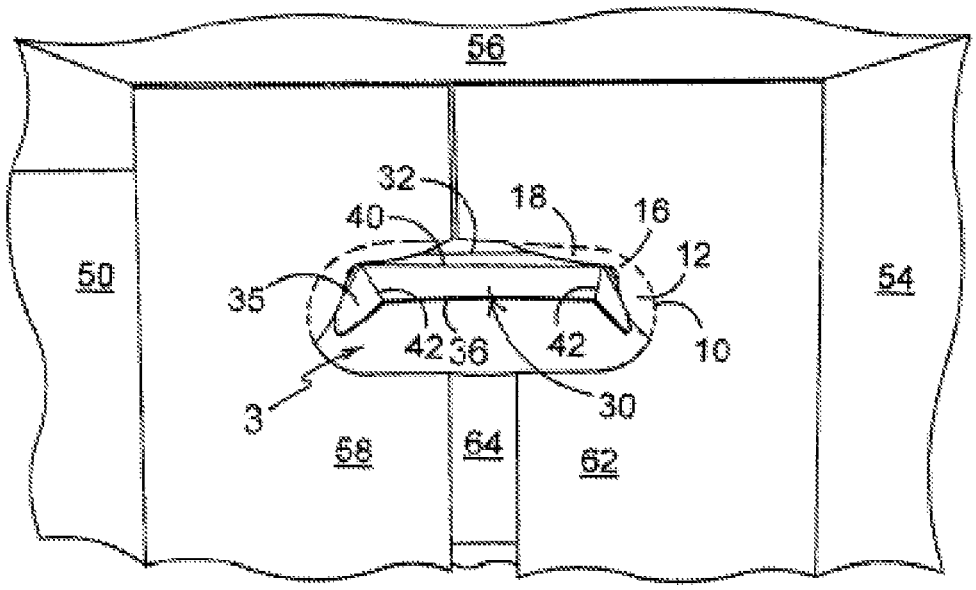
FIG. 6A shows a first step in a sequence of folding that takes place as the comfort flap is inserted into the handle cutouts, as viewed from inside the carton.
Figure 6B:
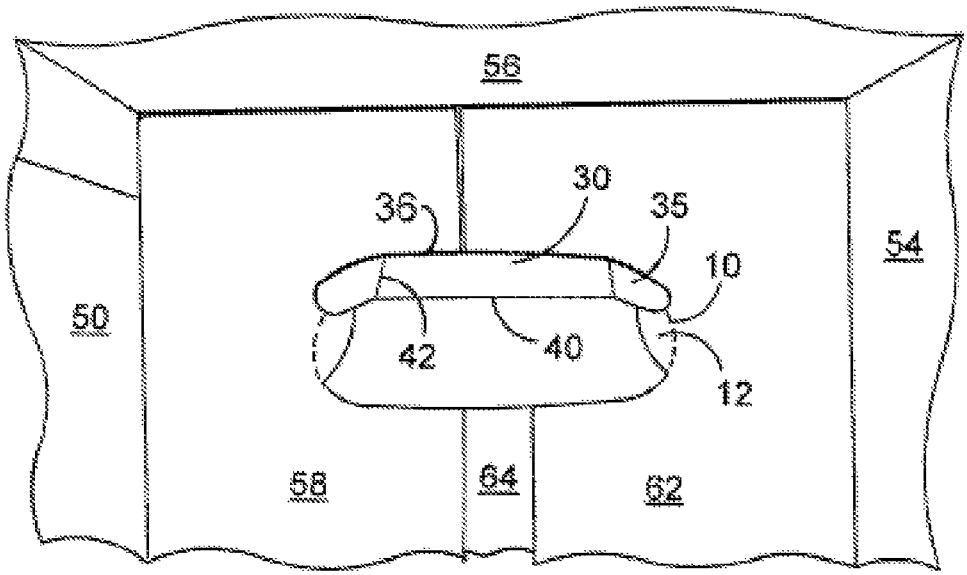
FIG. 6B shows a second step in a sequence of folding that takes place as the comfort flap is inserted into the handle cutouts, as viewed from inside the carton.

The comfort flap 30 is insertable through the handle opening 3 by folding it about the fold line 32 as shown in FIGS. 5, 6A and 6B. This movement will break nick portions 38 (shown in FIG. 4) that are preferably provided to frangibly connect an otherwise free edge 36 (best shown in FIGS. 6A and 6B) of the comfort flap 30 to the top end panel 64 or otherwise to the surrounding portions of material from which the comfort flap 30 is formed. As the comfort flap 30 is so folded, it causes inward deflection of the lower portion 12 and upper portion 18 of the reinforcing flap 22 as adjacent parts of the comfort flap 30 are pushed there-against. The material from which the upper and lower portions 18, 12 of the reinforcing flap 22 are formed will stretch proximate the free edge 15 of the reinforcing flap 22 defining the indent 14, and will bunch as necessary at the narrow portion 16 thereof as a result of the stress placed upon the upper portion 18 of the reinforcing flap 22 by the user's fingers. As this occurs, the upper and lower portions 18, 12 of the reinforcing flap 22 will deform partially inwardly of the handle opening 3 and the comfort flap 30 will deform around the upper portion 18 of the reinforcing flap 22 by virtue of the offset fold lines 32, 40.

The end tabs 35 of the comfort flap 30 extend across the free edge 15 of the indent 14 of the reinforcing flap 22. By virtue of the stretching and bunching of those lower 12 and upper 18 portion of the reinforcing flap 22, the indent 14 forms a "valley" into which a proximate edge of the aforementioned end tab 35 of the comfort flap 30 may rest. The upper edges (as viewed in FIG. 4) of the end tabs 35 engages the inside surfaces of the lower portions 12 of the reinforcing flaps 22 as shown in FIG. 6B. This overcomes the natural tendency of the comfort flap 30 to return to its original plane by hinging back about fold line 32 and thereby the comfort flap 30 remains in the folded position once folded and inserted into the aperture 3.

In use, the user inserts a hand through the handle opening 3 and thereby folds the comfort flap 30 inwardly through the hand aperture 3. As a result, the reinforcing flaps 22 fold or otherwise deform inwardly about the curved fold lines 10.

This places a load upon an uppermost edge of the handle opening 3 and the upper portion 18 of the reinforcing flap 22. The lower portion 12 of the reinforcing flap 22 prevents vertical tearing of the material of the handle panel 58, 62, by transferring a portion of the stress from this load to the adjacent portion of the handle panel 58, 62, via the lower portion 12 of the reinforcing flap 22. The connection between the lower 12 and upper 18 portions of the reinforcing flap 22 (i.e., the narrow portion 16) prevents the upper portion 18 from fully folding into coplanar contact with the respective one of the handle panel 58, 62 and therefore ensure that a portion of any load under which the upper portion 18 is placed is necessarily transferred to the lower portion 12, and thereby mitigate tearing. This stress acts from a point of maximal stress along the score line 10, around the rounded base of the indent 14, and into the adjacent material via lower portion 12 of the reinforcing flap 22. In addition, the lower portion 12 of the reinforcing flap 22 equally resists tearing of the material of the respective handle panel 58, 62, in a direction that is at least partially transverse to the force of the load placed upon the uppermost edge of the handle opening. More specifically, the lower portion 12 of each reinforcing flap 22 transfer any such transverse force to the reinforcing flap 22, around the rounded base of the indent 14, into the material of the handle panel 58, 62 above the upper portion 18 of the respective reinforcing flap 22.

This is advantageous in that it prevents "vertical tearing" and "horizontal tearing" of the handle structure 1, and thus the handle panels 58, 62 and is particularly advantageous in conditions where the packaging material has become moistened and thereby weakened. It is further advantageous that as stated above the lower portion 12 of each reinforcing flap 22 serves to retain the comfort flap 30 in a set up or folded position ready for subsequent use.

In the illustrated embodiment of FIG. 1, the handle structure 1 is shown applied to a blank 100 for forming a carton 110, shown in FIGS. 4 and 5. Specifically, the handle panels 58, 62 are side end panels 58, 62 of the blank 100 and the comfort flap 30 is defined within a top end panel 64 that is foldable into co-planar contact with the outside surfaces of those two side end panels 58 and 62.

Specifically, the illustrated blank 100 comprises a linear series of first side wall 50, bottom panel 52, second side wall 54, top panel 56 and glue panel 57 hinged one to the next by a series of fold lines 70, 72, 74 and 75 respectively. Hinged to the end edges of the first side wall 50 are side end panels 58. Corresponding side end panels 62 are hinged to the end edges of the second side panel 54 also. Hinged to the end edges of the bottom panel 52 are bottom end panels 60 and hinged to the end edges of the top panel 56 are top end panels 64.

With respect to the placement of panels, the blank 100 is symmetrical about the longitudinal axis of the linear series above, and therefore only one end of the blank 100 will be described.

To set up the blank 100 of FIG. 1 into a carton 110 (best shown in FIG. 4), the first 50 and second 54 side walls are folded up about their corresponding fold lines 70 and 72 so as to be set perpendicular to the bottom panel 52. The top panel 56 is then folded over to secure it to the glue panel 57 thereby forming a tubular structure having two opposed side walls 50, 54 and opposed top 52 and bottom wall 56. Each end of the tubular structure may then be closed by folding side end panels 58, 62 towards one another so as to become co-planar with one another, as best shown in FIG. 3. The top end panel 64 is then folded about the fold line 82 downwardly into co-planar contact with the proximate portions of the side end panels 58, 62 and is secured thereto by some means including, amongst others, adhesion or mechanical fastening. Bottom end panel 60 is then folded about the fold line 78 upwardly into co-planar contact with the proximate portions of the side end panels 58, 62 and the proximate portions of top end panel 64, and is secured thereto by some means including, amongst others, adhesion or mechanical fastening. This completes the closure of the respective end of the carton 110. This results in the set up carton configuration shown in FIG. 4.

Figure 7:
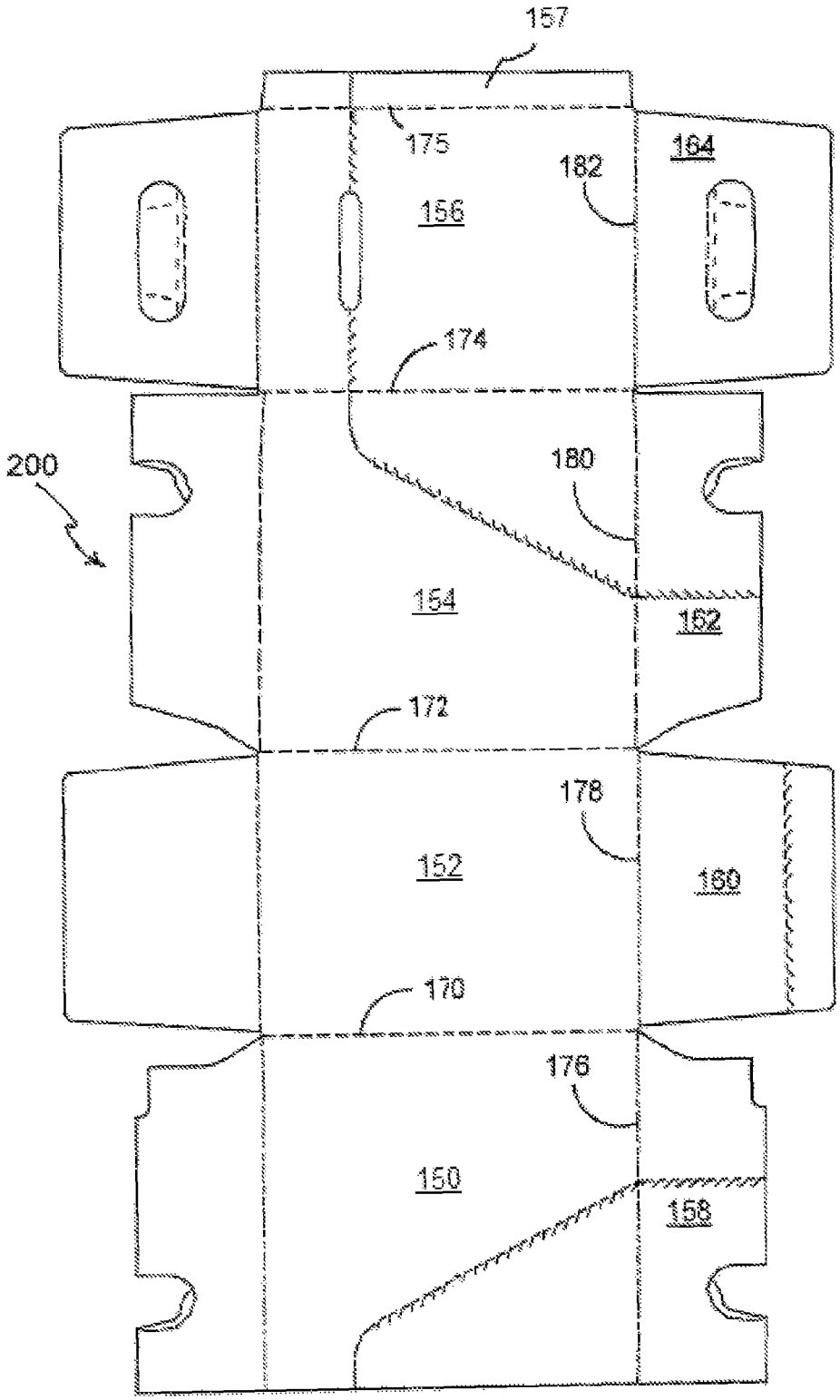
FIG. 7 shows an alternative blank for forming into a carton comprising a handle structure according to a second preferred embodiment of the present invention.

FIG. 7 shows an alternative embodiment of a blank 200 for forming a carton incorporating the handle structure 1 described above. Like numerals have been used for like features raised by 100, only the differences between this second embodiment and the first are described herein below.

The second embodiment has side end panels 158 and 162, wherein one of those side end panels 162 stops short of meeting the other 158 when folded to close the carton and to form a handle opening. This is due to the lack of an extended portion in first handle panel 162 that extends beyond a terminal point of the reinforcing flap 22. This means that no substantially continuous upper edge of the handle opening 3 is formed in the set up carton according to the second embodiment. Nonetheless, sufficient structural rigidity in this manner is accomplished through the securement of the top end panel 164 to the two side end panels 158, 162. The functionality of the handle cutout in each side end panel 158, 162 remains the same as in the first embodiment.

It is further contemplated that a third embodiment of the invention may incorporate the handle structure 1 described above formed entirely in a single handle panel (such as an end panel of a carton), rather than formed of two halves, one in each of two panels. In this third embodiment, a single side end panel extending at least far enough toward the opposing side panel to provide sufficient space to accommodate the entire handle opening 3, comprising score lines 10 in both of its upper corners, and connected by upper 20 and lower 4 cut lines along the continuous aperture edge. In this embodiment, a single reinforcing flap may be provided across the entire upper edge of the handle opening, or two reinforcing flaps may be provided, one for each upper corner of the aperture, as in the first embodiment.

It can be appreciated that various changes may be made within the scope of the present invention, for example, the size and shape of the panels and apertures may be adjusted to accommodate articles of differing size or shape.

In other embodiments of the invention it is envisaged that the carton may be formed without the use of glue, and that alternative means of securing panels of the blank together may be used such as, amongst other, welding, mechanical fasteners and provision of complementary locking tabs.

The blanks 100, 200 shown if FIGS. 1 and 7 respectively illustrate exemplary embodiments of access means formed by detachable portions of the carton that are defined by frangible lines. It is envisaged that these access means could be defined in portions of the top panel 56 and adjacent portions of the second side panel 54, as shown in FIG. 1. Alternatively, as shown in FIG. 7, the access means could extend from these portion into one of the ends of the carton such that the handle structure at that end is removable together with the access means. Alternative access means are contemplated within the scope set out in the attached claims.

It will be recognized that as used herein, directional references such as "top", "bottom", "front", "back", "end", "side", "inner", "outer", "upper" and "lower" do not limit the respective panels to such orientation, but merely serve to distinguish these panels from one another. Any reference to hinged connection should not be construed as necessarily referring to a single fold line only; indeed it is envisaged that hinged connection can be formed from one or more of the following, a short slit, a frangible line or a fold line without departing from the scope of the invention. The "score lines" described above are interchangeable with, amongst others, weakened lines, fold lines or perforations. Also, mention of "fold lines" throughout this description is not limited to single fold lines, and incorporate double fold lines or more, as necessary.

The folding process described above is strictly exemplary in nature, and it is envisaged that alternative procedures may be used. It is contemplated that the top end panels 64, 164 may be outermost from the end of the carton 110 such that each of them is secured to the outside surface of the respective bottom end panel 60, 160.

The invention claimed is:

1. A handle structure for a carton for packaging articles, the handle structure comprising a handle panel, a handle opening in the handle panel, and a reinforcing flap struck from the handle panel to define at least a part of the handle opening, the reinforcing flap comprising a first portion and a second portion connected to one another by a narrow portion defined by an indent in a free edge of the reinforcing flap, the reinforcing flap being hinged to the handle panel along a fold line so as to allow at least a part of the first portion to move out of the plane of the handle panel, wherein a base of said indent is positioned spaced from the fold line, wherein the fold line is curved at least in part proximate the base of the indent.

2. The handle structure according to claim 1, wherein the base of the indent is rounded.

3. The handle structure according to claim 2, wherein the reinforcing flap narrows at its terminal ends.

4. The handle structure according to claim 1, wherein one portion of the reinforcing flap extends to a first edge of the handle opening disposed between the fold line and a terminal edge of the handle panel.

5. The handle structure according to claim 1, further comprising a cover panel having a comfort flap hinged thereto, the comfort flap is foldable through the handle opening and positioned such that the comfort flap is in substantial registry with the handle opening.

6. A handle structure for a carton for packaging articles, the handle structure comprising a handle panel, a handle opening in the handle panel, and a reinforcing flap struck from the handle panel to define at least a part of the handle opening, the reinforcing flap comprising a first portion and a second portion connected to one another by a narrow portion defined by an indent in a free edge of the reinforcing flap, the reinforcing flap being hinged to the handle panel along a fold line so as to allow at least a part of the first portion to move out of the plane of the handle panel, the handle structure further comprising a cover panel having a comfort flap hinged thereto, the comfort flap is foldable through the handle opening and positioned such that the comfort flap is in substantial registry with the handle opening, wherein the comfort flap is sized such that the comfort flap, when folded through the handle opening, is engageable with the indent of the reinforcing flap to maintain the comfort flap in a folded position.

7. A handle structure for a carton for packaging articles, the handle structure comprising a handle panel, a handle opening in the handle panel, and a reinforcing flap struck from the handle panel to define at least a part of the handle opening, the reinforcing flap comprising a first portion and a second portion connected to one another by a narrow portion defined by an indent in a free edge of the reinforcing flap, the reinforcing flap being hinged to the handle panel along a fold line so as to allow at least a part of the first portion to move out of the plane of the handle panel, wherein the handle panel comprises a first end panel of a carton, and the handle opening comprises a cutout in a free edge of the first end panel.

8. The handle structure according to claim 7, wherein the handle panel further comprises a second end panel of the carton, and the handle opening further comprises a second cutout in a free edge of the second end panel.

9. The handle structure according to claim 8, wherein the first and second end panels are disposed in an adjacent, coplanar relationship to close an end of the carton.

10. The handle structure according to claim 8, wherein a portion of one of the first and second end panels extends substantially to the other of the first and second end panels so as to form an edge of the handle opening, by which the carton can be lifted.

11. A blank for forming a carton having a handle structure, the blank comprising primary panels for forming opposed side walls and opposed top and bottom wall, to form a tubular structure, and secondary panels to form opposed end closure walls of that tubular structure, each of the end closure walls comprising a first and a second side end panels, each of the side end panels comprising a free edge furthest from a first fold line which hinges said each said side end panel to one of the primary panels for forming the opposed side walls, said each said side end panel has a cutout defined along the free edge thereof, the cutout of said each said side end panel being provided with a reinforcing flap that comprises a first portion and a second portion connected to one another by a narrow portion defined by an indent in a free edge of the reinforcing flap, the reinforcing flap being hinged to said each said side end panel along a second fold line so as to allow at least part of the first portion to move out of the plane of said each said side end panel.

12. The blank according to claim 11, further comprising a top end panel that is foldable to overly the first and second end panels, the top end panel being provided with a comfort flap struck there from, the comfort flap being foldable through the handle cutouts.

13. The blank according to claim 12, wherein the comfort flap is sized such that the comfort flap, when folded through the handle cutouts, is engageable with the indent of the reinforcing flap of at least one of the side end panels to maintain the comfort flap in a folded position.

14. The blank according to claim 12, wherein the comfort flap comprises a tab that is engageable with the indent of the reinforcing flap of at least one of the side end panels to maintain the comfort flap in a folded position.

15. The blank according to claim 11, wherein a base of said indent is positioned spaced from the second fold line.

16. The blank according to claim 15, wherein the second fold line is curved at least in part proximate the base of the indent.

* * * * *